US005291947A

United States Patent [19]

Stracke

[11] Patent Number: 5,291,947

[45] Date of Patent: Mar. 8, 1994

[54] TUBING CONVEYED WELLBORE STRADDLE PACKER SYSTEM

[75] Inventor: Mark L. Stracke, Carrollton, Tex.

[73] Assignee: Atlantic Richfield Company, Los Angeles, Calif.

[21] Appl. No.: 895,307

[22] Filed: Jun. 8, 1992

[51] Int. Cl.[5] ..... E21B 33/124; E21B 33/127

[52] U.S. Cl. ..... 166/187; 166/188; 166/191; 277/34.6

[58] Field of Search ..... 166/191, 184, 185, 187, 166/188; 277/34, 34.6

[56] References Cited

U.S. PATENT DOCUMENTS

| | | | |
|---|---|---|---|
| 4,566,535 | 1/1986 | Sanford | 166/191 X |
| 4,685,516 | 8/1987 | Smith et al. | 166/65.1 |
| 4,711,301 | 12/1987 | Stringfellow | 166/187 |
| 4,759,406 | 7/1988 | Smith et al. | 166/65.1 |
| 4,787,744 | 11/1988 | Howell et al. | 166/66.4 |
| 4,962,815 | 10/1990 | Schultz et al. | 166/191 X |
| 5,058,673 | 10/1991 | Muller et al. | 166/191 X |
| 5,105,881 | 4/1992 | Thoms et al. | 166/191 X |

*Primary Examiner*—Terry Lee Melius
*Attorney, Agent, or Firm*—Michael E. Martin

[57] ABSTRACT

A tubing conveyed straddle packer system includes two inflatable packers interconnected with each other and spaced apart to provide for isolating a wellbore space for communicating pressure fluids between a formation zone of interest and the surface through the tubing string. An electrical cable extends within the tubing string and is operable to provide control signals to electrically controlled valves for inflation and deflation of the packers and for conveying fluids between the formation zone of interest and the tubing string and between the tubing string and the wellbore above and below the straddle packer system. A logging tool is interposed in the tubing string for precisely locating the straddle packer system in the well.

10 Claims, 3 Drawing Sheets

TUBING CONVEYED WELLBORE STRADDLE PACKER SYSTEM

BACKGROUND OF THE INVENTION

1. Field of the Invention

The present invention pertains to a coiled tubing conveyed, hydraulically inflatable straddle packer system for use in wells. Inflation and deflation of the packers, together with control of certain valves interposed in the tubing string is carried out by solenoid actuated valves controlled from the surface.

2. Background

In certain wellbore operations, such as stimulation of a particular formation zone of interest, production of reservoir fluids and pressure testing operations, it is desired to isolate a certain portion of the wellbore by the use of two separate inflatable packers which are interconnected by a tubing string or the like, sometimes referred to as a straddle packer arrangement. In this way, a certain zone in the formation can be isolated from the remainder of the wellbore and fluids can be injected into the isolated zone or produced from the isolated zone through a tubing string connected to the straddle packer arrangement.

The conveniences of using coilable metal tubing for conveying straddle packer arrangements into and out of wellbores have made this type of system more useful. However, conventional tubing conveyed straddle packer arrangements typically rely on mechanical movement of the tubing string to effect operation of certain setting mechanisms for inflating and deflating the packers. Certain control valves in the tubing string are opened and closed by the application of hydraulic fluid pressure through the tubing string. Mechanical-hydraulic controlled straddle packer systems are difficult to operate. Packer inflation failures and other system failures are not uncommon and often result in fishing operations. Packer location in the wellbore is also usually determined solely by measuring the amount of tubing paid out as the system is lowered into the wellbore. This arrangement lacks the degree of accuracy often required for operations in short, isolated zones. Moreover, the friction and drag forces acting on the tubing string in deviated and generally horizontally extending wellbores renders mechanical movement of the tubing string for actuation purposes difficult, if not impossible, to achieve.

Accordingly, there has developed a need for a more reliable and less complex system for isolating a zone in a formation intersected by a wellbore, particularly deviated and generally horizontal wellbores, wherein more accurate depth control of the location of a straddle packer system may be accomplished and a system capable of reliable operation may be provided for use. One solution to the problems associated with prior art straddle packer systems is provided by the present invention.

SUMMARY OF THE INVENTION

The present invention provides an improved straddle packer system which may be conveyed into a wellbore, including deviated and generally horizontal wellbores, by a coilable tubing string and the like.

In accordance with one important aspect of the present invention, a straddle packer system is provided having two spaced apart pressure fluid inflatable packers for isolating a zone in a wellbore, which straddle packer system is adapted for being run into and out of the wellbore on tubing, particularly coilable tubing and the like.

In accordance with another aspect of the present invention, a straddle packer system is provided wherein the packer elements are inflated and deflated by electrically controlled valves and a tubing string connected to the spaced apart packers is also provided with plural electrically controlled valves useful for circulating fluids within the wellbore and into and out of a formation which has been isolated by the spaced apart packers.

In accordance with yet a further aspect of the present invention, there is provided a straddle packer system for wellbores wherein more accurate control of the location of the packers is provided by a logging tool which is interposed in the tubing string with the straddle packer and circulation valve arrangement.

In accordance with yet a further important aspect of the present invention, a tubing conveyed straddle packer system is provided wherein spaced apart inflatable packers, spaced apart fluid circulation valves and a logging tool are all interconnected to each other by a tubing string having an electrical control cable disposed within the tubing string. Pressure fluid may be conveyed through the tubing string from the surface to the straddle packer system and from the straddle packer system to the surface. Control of inflation of the packers and the fluid circulation valves is carried out from the surface by an electrical control system and positioning of the straddle packers is easily carried out by monitoring signals from the tubing conveyed logging tool.

Those skilled in the art will recognize the above described advantages and features of the present invention together with other superior aspects thereof upon reading the detailed description which follows in conjunction with the drawing.

DESCRIPTION OF PREFERRED EMBODIMENTS

Figure 1:
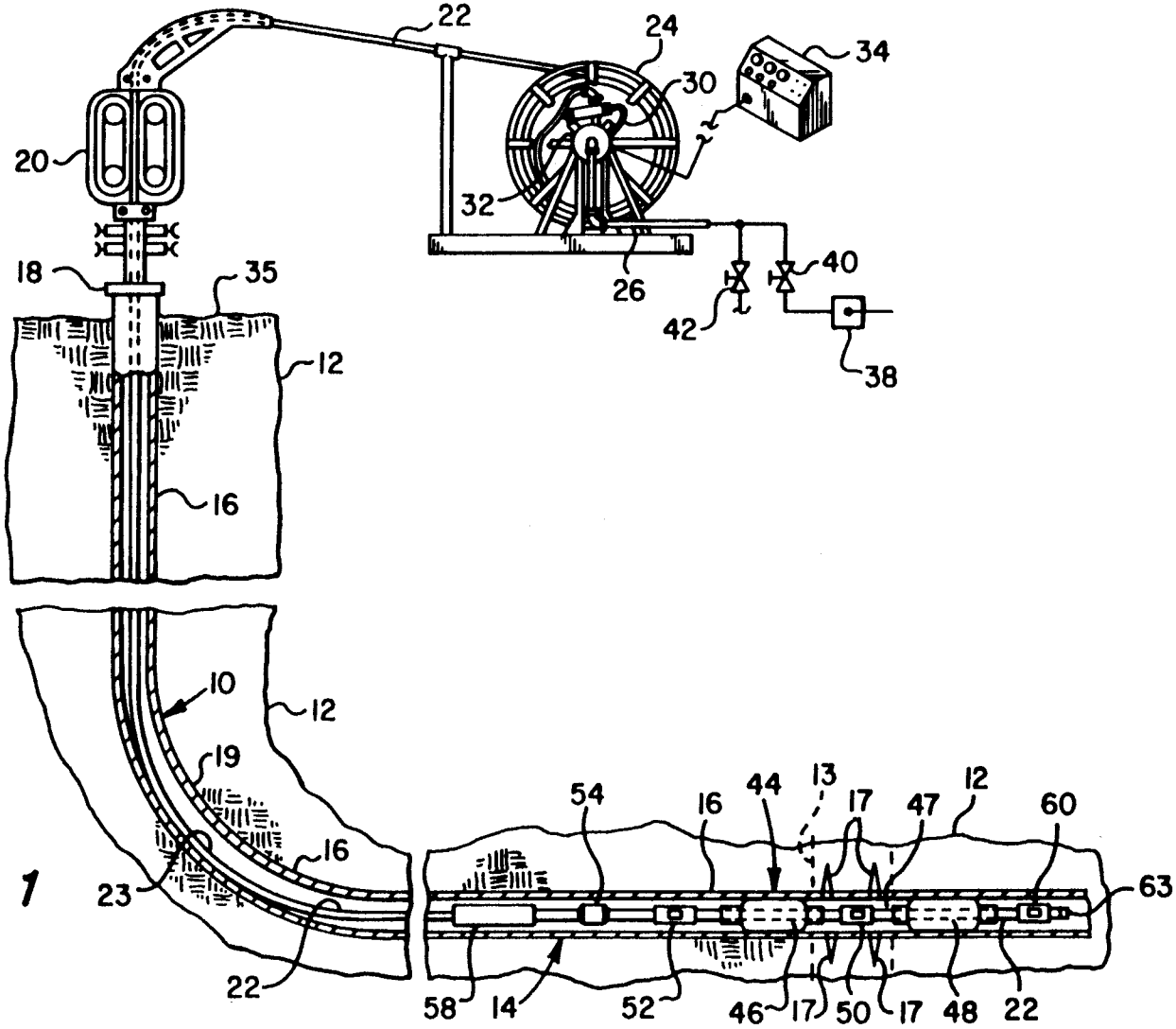
FIG. 1 is a view in somewhat diagrammatic form of a well in which the straddle packer system of the present invention is shown deployed.

In the description which follows, like parts are marked throughout the specification and drawing with the same reference numerals, respectively. The drawing figures are not necessarily to scale and certain features of the invention are shown in somewhat schematic or simplified form in the interest of clarity and conciseness.

Referring to FIG. 1, there is illustrated a well 10 extending within an earth formation 12 and including a highly deviated, generally horizontally extending portion 14. The well 10 is provided with a wellbore conduit or casing 16 extending substantially throughout the length of the portion of the well indicated in the drawing figure. The casing 16 is terminated at the surface in a wellhead 18 on which is mounted a conventional coilable tubing injector apparatus 20. Elongated coilable metal tubing 22 is shown being deployed in the well 10 by the injector 20 from a storage reel 24. Pressure fluid may be conveyed to and from the tubing 22 by way of a conduit 26 which is in communication with the tubing 22 through a hub arrangement 32 of the reel 24. An elongated, multiconductor electrical cable 30 also extends within the tubing 22 and is in electric signal conducting relationship with a control unit 34 disposed at the earth's surface 35 by way of suitable means such as slipring assemblies, not shown, also deployed in the reel hub 32. The conduit 26 is shown in communication with a suitable pump 38 by way of a valve 40 and a shutoff valve 42 is also interconnected with the conduit 26 for conducting fluids from the coilable tubing 22 and the conduit 26. One arrangement for providing a coilable tubing string having a multiconductor electrical cable disposed therein together with means for communicating pressure fluid to and from the tubing string and conducting electrical signals between the cable and the control unit 34 is described in detail in U.S. Pat. No. 4,685,516, issued Aug. 11, 1987 to Lonnie J. Smith, et al and assigned to the assignee of the present invention.

The tubing 22 is shown extending within the well 10 and is connected to a unique straddle packer system generally designated by the numeral 44. The straddle packer system 44 is characterized by two spaced apart inflatable packers 46 and 48 which are interconnected by sections of tubing 22 and a circulation valve, generally designated by a numeral 50. For convenience, short interconnected sections of tubing which connect the components of the straddle packer system 44 with the elongated tubing string will collectively be referenced by the numeral 22. The packers 46 and 48 may be of a type commercially available, and modified for the system 44. By way of example, one commercial source of inflatable packers which may be modified to comprise the packers 46 and 48 is TAM International, Inc., Houston, Tex. TAM type CT packers may be modified to comprise the packers 46 and 48 which each may be identical to the other. Alternatively, the packers 46 and 48 may be of a type similar to that described in U.S. Pat. No. 4,787,446 to Howell, et al and assigned to the assignee of this invention. The assembly of the packers 46 and 48, together with the circulation valve 50, is shown connected to a second circulation valve 52 interposed between a special tubing coupling 54 and the packer 46. A logging tool 58 is also interposed in the tubing string 22 in the position illustrated in FIG. 1, although the logging tool may be disposed in other positions in the tubing string. Finally, a third circulation valve 60 is disposed in the well 10 "below" the inflatable packer 48 and connected thereto by a section of tubing. The distal end of the tubing 22 is closed by a suitable plug 63 or may form the outlet port for a modified version of the valve 60.

As illustrated in FIG. 1, the straddle packer system 44 may be deployed into the well 10 and into the horizontal wellbore portion 14 for isolating a formation zone 13, for example, between the packers 46 and 48 whereby fluids may be introduced into or produced from the formation zone 13 by way of suitable conventional perforations which extend through the casing 16 and into the formation 12, as indicated by the numeral 17 in FIG. 1. Upon insertion of the straddle packer system 44 into the well 10 in the position shown, the packers 46 and 48 are inflated to isolate the wellbore space 47 between the packers 46 and 48 from the remainder of the wellbore whereby fluids may flow into or out of the wellbore through the perforations 17, the circulation valve 50 and the tubing string 22. In this way, several types of wellbore operations may be carried out such as producing fluids from the formation zone 13 and stimulating the formation zone with various fluid treatments and the like. Precise location of the straddle packer system 44 may be provided for by the logging tool 58 which may emit continuous signals which are transmitted through the cable 30 to the surface as the straddle packer system is conveyed into the wellbore so that the straddle packer system may be spotted rather accurately in the wellbore. Even though the well 10 is deviated, as indicated by the curved portion 19 of the casing 16, and the tubing 22 has a curved portion 23 which is in contact with the casing wall, as illustrated, operation of the straddle packer system 44 may be carried out without concern for either frictional or drag forces exerted on the tubing 22.

Figure 2:
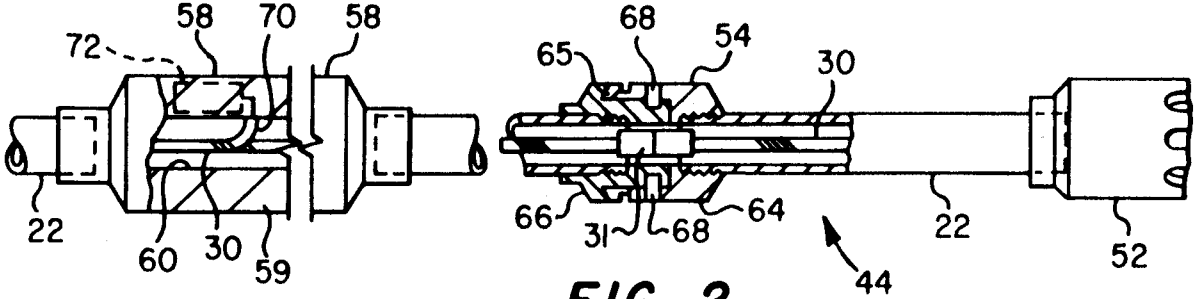
FIG. 2 is a detail view of a portion of the straddle packer system including a detachable coupling and a portion of a logging tool.

Referring now to FIG. 2, a portion of the straddle packer system 44 is illustrated in further detail, including the logging tool 58, the coupling 54 and a portion of the valve 52. As illustrated in FIG. 2, the coupling 54 is of a frangible type having a first body part 64 which is connected to a second body part 66 by suitable shear members such as pins 68. Accordingly, in response to a predetermined tension on the coupling 54, the parts 64 and 66 will separate and a conventional pin type connector assembly 31 for the cable 30 will also decouple to permit withdrawal of a major portion of the tubing string 22, including the logging tool 58 and the coupling body 66, from the well 10 in the event that the remainder of the straddle packer system 44 becomes stuck. The body part 64 may be formed with a suitable fishing head 65 thereon, as indicated in FIG. 2. The logging tool 58, coupling 54 and valve 52, as well as the packers 46 and 48 and the other circulating valves 50 and 60, are each interconnected by sections of the tubing making up the tubing string 22 which may be each threadedly connected to the respective components shown in a conventional manner.

The logging tool 58 may be one of several types which can, with a high degree of accuracy, determine its position in a well based on prior logging of the well. For example, certain types of commercially available logging tools develop a "log" of the earth formation based on nuclear radiation characteristics of the formation. In this way, the formation develops a particular signature at each position throughout the length of the well which may be identified as the logging tool is inserted in the well and operated to measure radiation in the wellbore. Other types of logging tools, including acoustic types, may be similarly utilized to first develop the "signature" or "log" of the well and then redeployed such as with the straddle packer system 44 to accurately determine the position of straddle packer system in the well based on such earlier signature. The logging tool 58 has a suitable body 59 having a central bore 61 formed therein to permit the passage of fluids through the logging tool and the tubing string 22. The cable 30 also passes through the bore 61 and a set of conductors useful in transmitting the signals for operation of the logging tool 58 may branch off from the cable 30 as indicated by a numeral 70 in FIG. 2. In this way, operation of a logging tool detector element 72 may be carried out to provide information at the control unit 34 which will indicate the position of the tool 58 and the system 44 in the well 10. The accuracy of nuclear radiation type logging tools is such that it is possible to isolate short intervals of an earth formation of from one to ten feet in length, including the zone 13, for example, for the various operations previously described.

Figure 3:
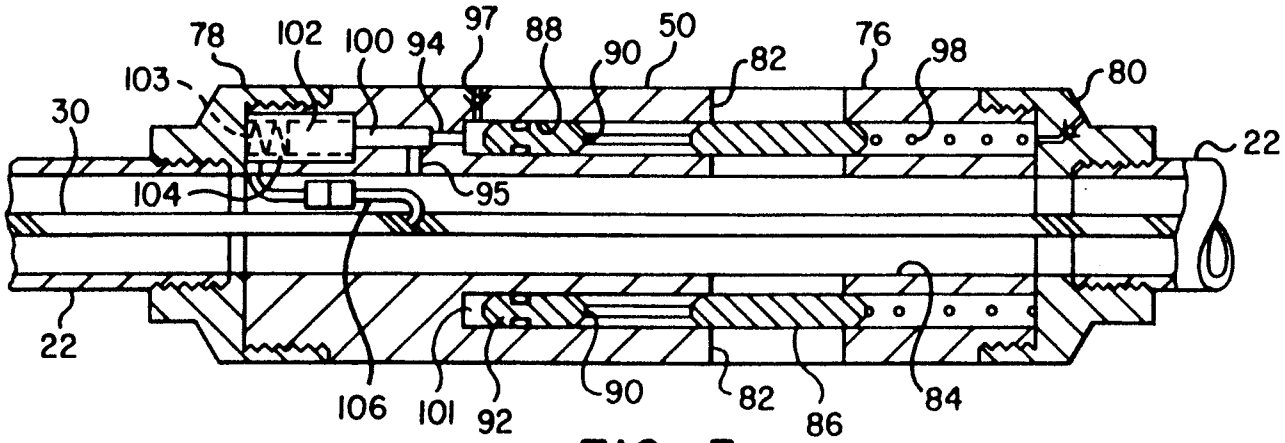
FIG. 3 is a longitudinal central section view of one of the circulation valves interposed in the straddle packer system.

Injection into or production of fluids from the well 10 may be carried out by the straddle packer system 44 by way of any one of the valves 50, 52 and 60. By way of example, the valve 50 is illustrated in FIG. 3. The valves 52 and 60 are essentially identical to the valve 50 for the sake of discussion herein. The valve 50 is characterized by a generally cylindrical body 76 having opposed removable head members 78 and 80 threadedly connected thereto. The body 76 has a plurality of radially extensible ports 82 formed therein and which intersect a central passage 84 which is in communication with the tubing 22 for conducting fluid therethrough. By way of example, the valve 50 includes an annular sleeve type closure member 86 which is disposed in an annular bore 88 formed in the body 76. The closure member 86 includes suitable ports 90 formed therein which, when aligned with the ports 82, permit flow to or from the tubing 22 by way of the valve 50. The closure member 86 includes a piston head 92 which is operable to receive pressure fluid through a passage 94 to move the valve from the closed position shown, against the bias of a closure spring 98, to an open position. Pressure fluid is communicated to act on the piston head 92 by way of the passage 94 from a passage 95 which opens into the bore 84 and may be blocked by a plunger type closure member 100 of a solenoid actuated valve 102. The valve 102 includes the solenoid actuated plunger 100 and a suitable solenoid actuator 104 which is adapted to receive a control signal by way of conductor means 106 which branches off from the cable 30 as illustrated in FIG. 3. The valve 102 is a normally open valve and is closed when its solenoid actuator 104 is energized. A small vent port 97 may be provided to slowly vent the actuator chamber 101 for the closure member 86 when the valve 102 is closed.

The valve 50 is exemplary but is of a general design which may be suitable for use in the straddle packer system 44. The valves 52 and 60 may be identical in construction to the valve 50 and need not be further described herein in the interest of clarity and conciseness. Operation of the valve 50 may be carried out by suitable signals conducted through the cable 30 and the conductor means 106 and may be controlled from the surface disposed control unit 34. Upon deenergization of the solenoid 104, the plunger 100 is withdrawn away from covering the passage 95 by extension spring means to permit communication of pressure fluid to the chamber 101 to cause the closure member 86 to move to an open position. Upon energization of the solenoid 104 the plunger 100 moves to the closed position shown and, upon bleed-down of the chamber 101 through the passage 97, the closure member 86 may be returned to the closed position illustrated.

Figure 4:
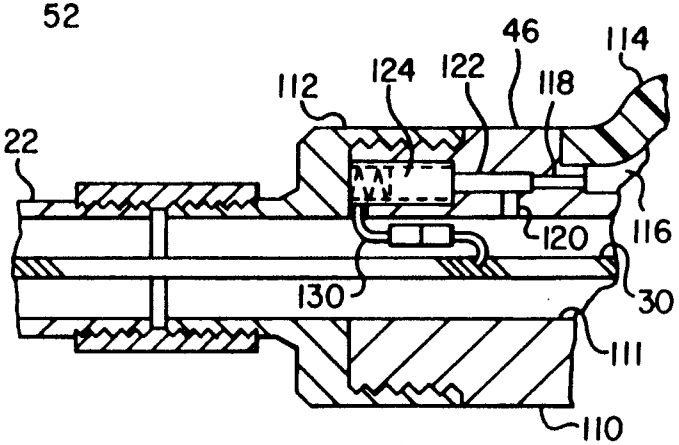
FIG. 4 is a detail section view of a portion of one of the inflatable packers.

Referring now to FIG. 4, a portion of the packer 46 is illustrated by way of example. The packer 46 includes a body member 110 which is adapted to be threadedly cdupled to the tubing 22 by way of a removable head portion 112. A tubular, radially distendable packer member 114 is secured to the body member 110 in a conventional manner and is responsive to pressure fluid admitted to a chamber 116, by way of a passage 118, to inflate and seal off the wellbore in a manner understood by those skilled in the art. The passage 118 is operable to be in communication with a bore 111, which ext ends through the body 110, by way of a passage 120 in response to operation of the plunger 122 of solenoid actuated valve 124. The valve 124 is similar to the valve 102 and is operable to receive electrical control signals from a conductor 130 which branches off from the cable assembly 30, as illustrated in FIG. 4.

Figure 5:
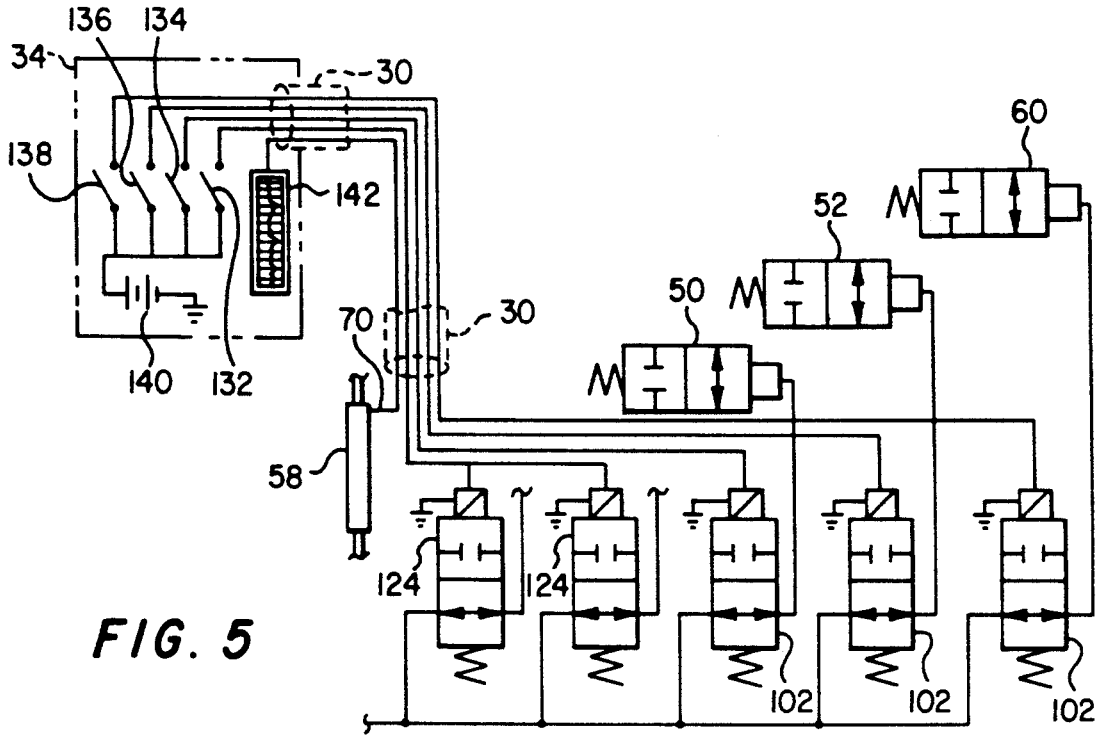
FIG. 5 is a schematic diagram of a control circuit for the straddle packer system.

Referring now to FIG. 5, the valves 124 of each of the inflatable packers 46 and 48 are illustrated in circuit with a control switch 132 located at the control unit 34. In like manner, each of the pilot control valves 102 for the respective annular sleeve valves 50, 52 and 60 are shown in respective control circuits including switches 134, 136 and 138. The switches 138 are shown in circuit with a source of electric power 140. Also shown in FIG. 5 is a visual display means 142 operably connected to the logging tool 58 by way of conductor cable 70 wherein the position of the straddle packer system 44 may be accurately determined as it is inserted in the well 10. In certain applications it may be desirable to individually control the valves 124 by separate switches so that either one of the packers 46 and 48 may be inflated while the other packer is maintained in a deflated condition.

The straddle packer system 44, when operated with the valves 50, 52 and 60 and the control circuit illustrated in FIG. 5, may be used to isolate a zone in a formation such as the zone 13 and inject fluids into the formation through the tubing string 22 and the valve 50 once the packers 46 and 48 have been inflated to form a substantially fluid tight seal between each other and isolating wellbore space 47 between the packers as illustrated in FIG. 1. The valves 52 and 60 may also be selectively opened and closed to circulate fluid between the tubing string 22 and the wellbore defined by the casing 16 at the respective points where these valves are located. For example, during insertion of the straddle packer system 44 into a well, the valve 60 may be opened and fluid circulated through the tubing string 22 and out of the valve 60 into the wellbore to perform certain washing operations. Once the straddle packer system 44 has been placed in the desired location within the well 10, the valve 60 may be closed and the valves 124 of each of the packers 46 and 48 opened to provide for inflation of the packers to seal off the space 47 between the packers within the well from the remainder of the wellbore. The valve 50 may then be selectively actuated when it is desired to inject fluids through the tubing string 22 and into the formation zone 13 by way of the perforations 17, for example. The valve 52 may also be actuated at will to circulate fluid between the tubing string 22 and the well 10. Other wellbore operations may be carried out using the packer system 44 including pressure testing of downhole equipment and a formation zone of interest.

Figure 6:
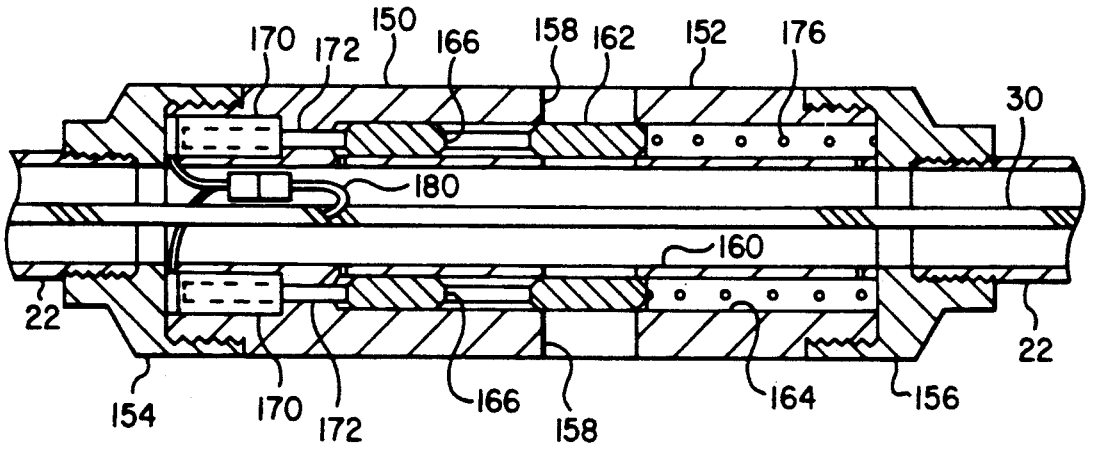
FIG. 6 is a view similar to FIG. 3 showing an alternate embodiment of a circulation valve.

Referring now to FIG. 6, there is illustrated an alternate embodiment of an in-line valve for insertion in the tubing string 22 and generally designated by the numeral 150. The valve 150 is similar to the valve 50 and may be used in place of any one or all of the valves 50, 52 and 60. For example, the valve 150 would preferably be used in place of the valve 50 when it is desired to produce fluids from the formation zone 13 into the tubing string 22 for flow to the surface or to another portion of the wellbore. The valve 150 includes a generally cylindrical body member 152 and opposed head members 154 and 156 threadedly connected to the body member. Each of the head members is connected to the tubing string 22 as indicated. The body member 152 includes plural radially extending ports 158 which open into a central bore 160 but may be blocked from flow communication with the bore by a generally annular sleeve type sliding closure member 162 disposed in an annular slot 164 formed in the body member 152 in a manner similar to the construction of the valve 50. However, the closure member 162 is not actuated between its closed and open positions directly by pressure fluid but is, instead, moved to a position wherein its ports 166 are aligned with the ports 158 by a pair of solenoid actuators 170 The actuators 170 each include plunger members 172 which are operably engaged with the closure member 162 for moving the closure member from its closed position, shown in FIG. 6, to an open position wherein the ports 166 are aligned with the ports 158. A closure spring 176 is disposed in the slot 164 for biasing the closure member 162 in the position shown in FIG. 6. Electric signals are communicated to the actuators 170 by way of conductor means 180 which is shown branching off from the cable 30.

Accordingly, in applications wherein pressure fluid is communicated from the well 10 into the tubing string 22 as well as in certain other instances, it may be desirable to utilize valves such as the valve 152 in place of the valve 50 and possibly in place of the valves 52 and 60 in the straddle packer system 44 whereby the valves may be actuated directly by electrical power rather than in a pilot pressure fluid arrangement such as illustrated and described in conjunction with FIGS. 3 and 5.

The components of the straddle packer system 44 described above may be constructed using conventional materials and engineering practices for downhole well tools and devices. Preferred embodiments of a straddle packer system, together with certain components therefor, have been described in detail herein. However, those skilled in the art will recognize that various substitutions and modifications may be made to the embodiments described without departing from the scope and spirit of the invention recited in the appended claims.

What is claimed is:

1. A straddle packer system for insertion in a well, comprising:

spaced apart inflatable packers interconnected by tubing means;

packer control valve means associated with each of said packers for providing pressure fluid to inflate said packers to form a substantially fluid tight seal in a portion of said well between said packers, said packer control valve means being electrically controlled to provide pressure fluid to inflate said packers, respectively;

a tubing string connected to said packers for conveying pressure fluid to inflate said packers, respectively;

electrically controlled circulation valve means interposed in said tubing means between said packers for conducting pressure fluid between a space in said well between said packers and said tubing string; and electrical conductor means associated with said tubing string for conducting electrical signals to said packer control valve means for controlling at least one of inflation and deflation of said packers, respectively.

2. The system set forth in claim 1 including:

electrically controlled valve means interposed in said tubing string between a wellhead associated with said well and said packers for controlling the flow of pressure fluid between said tubing string and a portion of said well between said packers and said wellhead.

3. The system set forth in claim 1 including:

electrically controlled valve means in communication with said tubing string for conducting pressure fluid between said tubing string and said well.

4. The system set forth in claim 1 including:

coupling means interposed in said tubing string between a wellhead of said well and said packers and operable to disconnect a portion of said tubing string from said packers.

5. The system set forth in claim 1 including:

means interposed in said tubing string for providing signals to determine the location of said packers in said well during traversal of said packers within said well.

6. The system set forth in claim 1 wherein:

at least one of said electrically controlled valve means comprises an electrical actuator for controlling the flow of pressure fluid to act on said one electrically controlled valve means to move said one electrically controlled valve means between at least one of open and closed positions.

7. The system set forth in claim 1 wherein:

at least one of said electrically controlled valve means includes electrical actuator means for moving a closure member of said electrically controlled valve means between open and closed positions.

8. A tubing conveyed straddle packer system for insertion in a well to isolate a space in said well for conducting pressure fluid between a zone in an earth formation and said tubing comprising:

a coilable tubing string including an electrical cable disposed therein, means for conducting electrical signals between said cable and control means at the earth's surface and means for conducting pressure fluid to and from said tubing string;

a pair of spaced apart inflatable packers connected to said tubing string for insertion in said well and for placement at a predetermined location in said well, said packers each including pressure fluid inflatable elements for forming a substantially fluid tight seal with said well;

packer control valve means associated with each of said packers for providing pressure fluid to inflate said elements of said packers, respectively;

at least one electrically controlled valve interposed in said tubing string between said packers for controlling the flow of fluid between said well and said tubing string; and control means for providing electrical signals through said cable for controlling said electrically controlled valve.

9. The system set forth in claim 8 including:

electrically controlled valve means interposed in said tubing string between a wellhead associated with said well and said packers for controlling the flow of pressure fluid between said tubing string and a portion of said well between said packers and said wellhead.

10. The system set forth in claim 8 including:

coupling means interposed in said tubing string between a wellhead of said well and said packers and operable to disconnect a portion of said tubing string from said packers.

* * * * *